US009175811B2

(12) United States Patent
Van De Ven et al.

(10) Patent No.: US 9,175,811 B2
(45) Date of Patent: Nov. 3, 2015

(54) SOLID STATE LIGHTING DEVICE, AND METHOD OF ASSEMBLING THE SAME

(75) Inventors: Antony Paul Van De Ven, Hong Kong (CN); Gerald H. Negley, Durham, NC (US); Ian Darley, Sydney (AU); Martin Bertock, legal representative, Brookvale (AU)

(73) Assignee: Cree, Inc., Durham, NC (US)

( * ) Notice: Subject to any disclaimer, the term of this patent is extended or adjusted under 35 U.S.C. 154(b) by 599 days.

(21) Appl. No.: 13/022,180

(22) Filed: Feb. 7, 2011
(Under 37 CFR 1.47)

(65) Prior Publication Data

US 2011/0267812 A1 Nov. 3, 2011

Related U.S. Application Data

(60) Provisional application No. 61/303,797, filed on Feb. 12, 2010.

(51) Int. Cl.
*F21K 99/00* (2010.01)
*F21S 4/00* (2006.01)
(Continued)

(52) U.S. Cl.
CPC ... *F21K 9/00* (2013.01); *F21K 9/13* (2013.01); *F21S 4/003* (2013.01); *F21Y 2101/02* (2013.01); *F21Y 2111/001* (2013.01)

(58) Field of Classification Search
CPC ..... F21K 9/00; F21K 9/13; F21Y 2111/001; F21Y 2101/02; F21Y 2103/003; F21Y 2111/005; F21Y 2111/007; F21Y 2103/022; F21S 4/003; F21S 48/215; F21S 4/002; F21S 4/006; H01L 2924/12041; H01L 33/20; H01L 51/52; H01L 31/035281; H01L 2224/48092; H01L 33/54; H01L 33/642; H05K 2201/10106; H05K 1/189; G02B 19/0061; G02B 6/0073; G02B 19/0066
USPC ..... 362/480, 546, 547, 218, 294, 555, 362/249.01, 249.02, 367, 373–375, 368, 362/240, 362; 313/20, 45, 46; 439/487; 257/81
See application file for complete search history.

(56) References Cited

U.S. PATENT DOCUMENTS 2,398,754 A * 4/1946 Morrison ..... 362/216
4,212,290 A * 7/1980 Warnken ..... 126/684
(Continued)

FOREIGN PATENT DOCUMENTS

JP 2002-184209 * 6/2002
WO 02/17690 2/2002

OTHER PUBLICATIONS

U.S. Appl. No. 61/245,688, filed Sep. 25, 2009, Pickard.
(Continued)

*Primary Examiner* — Anh Mai
*Assistant Examiner* — Fatima Farokhrooz
(74) *Attorney, Agent, or Firm* — Burr & Brown, PLLC

(57) ABSTRACT

A lighting device comprising a light emitter positioning element and first and second solid state light emitters positioned on the first light emitter positioning element, at least a first portion of the first light emitter positioning element of a spiral shape. Also, a lighting device comprising first and second solid state light emitters and means for dissipating heat from them. Also, a method of assembling a lighting device, comprising positioning a first light emitter positioning element that comprises a ledge, so that at least a part of it is in contact with a support structure, at least first and second solid state light emitters being on the positioning element, and pressing the positioning element to bring it into contact with the ledge.

20 Claims, 6 Drawing Sheets

(51) Int. Cl.
*F21Y 101/02* (2006.01)
*F21Y 111/00* (2006.01)

(56) References Cited

U.S. PATENT DOCUMENTS

| | | | | |
|---|---|---|---|---|
| 5,359,504 | A * | 10/1994 | Ohmi et al. | 360/137 |
| 5,561,346 | A * | 10/1996 | Byrne | 313/512 |
| 6,132,063 | A * | 10/2000 | Byers | 362/249.11 |
| 6,580,228 | B1 * | 6/2003 | Chen et al. | 315/185 R |
| 7,210,832 | B2 | 5/2007 | Huang | |
| 7,213,940 | B1 | 5/2007 | Van De Ven et al. | |
| 7,490,950 | B1 * | 2/2009 | Meyers | 362/123 |
| 2003/0090910 | A1 | 5/2003 | Chen | |
| 2004/0083943 | A1 * | 5/2004 | Huang | 116/63 C |
| 2005/0162850 | A1 * | 7/2005 | Luk et al. | 362/227 |
| 2007/0137074 | A1 | 6/2007 | Van de Ven | |
| 2007/0139920 | A1 | 6/2007 | Van de Ven | |
| 2007/0139923 | A1 | 6/2007 | Van De Ven et al. | |
| 2007/0170447 | A1 | 7/2007 | Negley | |
| 2007/0171145 | A1 | 7/2007 | Coleman | |
| 2007/0236911 | A1 | 10/2007 | Negley | |
| 2007/0263393 | A1 | 11/2007 | Van de Ven | |
| 2007/0267983 | A1 | 11/2007 | Van de Ven | |
| 2007/0274063 | A1 | 11/2007 | Negley | |
| 2007/0274080 | A1 | 11/2007 | Negley | |
| 2007/0278503 | A1 | 12/2007 | Van de Ven | |
| 2007/0278934 | A1 | 12/2007 | Van de Ven | |
| 2007/0278974 | A1 | 12/2007 | Van de Ven | |
| 2007/0279440 | A1 | 12/2007 | Negley | |
| 2007/0279903 | A1 | 12/2007 | Negley | |
| 2007/0280624 | A1 | 12/2007 | Negley | |
| 2008/0080181 | A1 * | 4/2008 | Yu et al. | 362/249 |
| 2008/0084685 | A1 | 4/2008 | Van de Ven | |
| 2008/0084700 | A1 | 4/2008 | Van de Ven | |
| 2008/0084701 | A1 | 4/2008 | Van de Ven | |
| 2008/0088248 | A1 | 4/2008 | Myers | |
| 2008/0089053 | A1 | 4/2008 | Negley | |
| 2008/0106895 | A1 | 5/2008 | Van de Ven | |
| 2008/0106907 | A1 | 5/2008 | Trott | |
| 2008/0112168 | A1 | 5/2008 | Pickard | |
| 2008/0112170 | A1 | 5/2008 | Trott | |
| 2008/0112183 | A1 | 5/2008 | Negley | |
| 2008/0130285 | A1 | 6/2008 | Negley | |
| 2008/0136313 | A1 | 6/2008 | Van de Ven | |
| 2008/0137347 | A1 | 6/2008 | Trott | |
| 2008/0165525 | A1 * | 7/2008 | Chang | 362/123 |
| 2008/0180949 | A1 * | 7/2008 | Liao et al. | 362/251 |
| 2008/0259589 | A1 | 10/2008 | Van de Ven | |
| 2008/0266833 | A1 * | 10/2008 | Thomas | 362/84 |
| 2008/0278928 | A1 | 11/2008 | Van de Ven | |
| 2008/0278940 | A1 | 11/2008 | Van de Ven | |
| 2008/0278950 | A1 | 11/2008 | Pickard | |
| 2008/0278952 | A1 | 11/2008 | Trott | |
| 2008/0278957 | A1 | 11/2008 | Pickard | |
| 2008/0304260 | A1 | 12/2008 | Van de Ven | |
| 2008/0304261 | A1 | 12/2008 | Van de Ven | |
| 2008/0304269 | A1 | 12/2008 | Pickard | |
| 2008/0309255 | A1 | 12/2008 | Myers | |
| 2009/0040776 | A1 * | 2/2009 | Zhang et al. | 362/373 |
| 2009/0108269 | A1 | 4/2009 | Negley | |
| 2009/0109674 | A1 * | 4/2009 | Lodhie | 362/249.02 |
| 2009/0160363 | A1 | 6/2009 | Negley | |
| 2009/0161356 | A1 | 6/2009 | Negley | |
| 2009/0184616 | A1 | 7/2009 | Van de Ven | |
| 2009/0184662 | A1 | 7/2009 | Given | |
| 2009/0184666 | A1 | 7/2009 | Myers | |
| 2009/0190351 | A1 * | 7/2009 | Shiraishi et al. | 362/249.01 |
| 2009/0296384 | A1 | 12/2009 | Van de Ven | |
| 2010/0020532 | A1 | 1/2010 | Negley | |
| 2010/0102199 | A1 | 4/2010 | Negley | |
| 2010/0102697 | A1 | 4/2010 | Van de Ven | |
| 2010/0103678 | A1 | 4/2010 | Van de Ven | |
| 2010/0290208 | A1 | 11/2010 | Pickard | |
| 2010/0290222 | A1 | 11/2010 | Pickard | |
| 2010/0315822 | A1 * | 12/2010 | Schnitzer | 362/360 |
| 2010/0327781 | A1 * | 12/2010 | Luo et al. | 315/320 |
| 2011/0019433 | A1 * | 1/2011 | Dussault | 362/555 |
| 2011/0031894 | A1 | 2/2011 | Van de Ven | |
| 2011/0068696 | A1 | 3/2011 | Van de Ven | |
| 2011/0068702 | A1 | 3/2011 | Van de Ven | |
| 2011/0075411 | A1 | 3/2011 | Van de Ven | |
| 2011/0075414 | A1 | 3/2011 | Van de Ven | |
| 2011/0075422 | A1 | 3/2011 | Van de Ven | |
| 2011/0075423 | A1 | 3/2011 | Van de Ven | |

OTHER PUBLICATIONS

U.S. Appl. No. 12/582,206, filed Oct. 20, 2009, Pickard.
U.S. Appl. No. 12/607,355, filed Oct. 28, 2009, Pickard.
U.S. Appl. No. 12/683,886, filed Jan. 7, 2010, Pickard.
U.S. Appl. No. 13/022,142, filed Feb. 7, 2011, Van de Ven.
Savage, Neil, "Cheaper LEDs Possible by Growing Gallium Nitride on Silicon", http://spectrum/ieee.org/computing/hardware/cheaper-leds-possible-by-growing-gallium-ni . . ., Aug. 21, 2009, 2 pages.
"Ultrathin light-emitting diodes create new classes of lighting and display systems", http://www.physorg.com/print169997059.html, Aug. 21, 2009, 2 pages.
English Translation of Reference *C1* (JP 2002-184209) provided by the Chinese counsel, 10 pages.

* cited by examiner

SOLID STATE LIGHTING DEVICE, AND METHOD OF ASSEMBLING THE SAME

CROSS-REFERENCE TO RELATED APPLICATIONS

This application claims the benefit of U.S. Provisional Patent Application No. 61/303,797, filed Feb. 12, 2010, the entirety of which is incorporated herein by reference as if set forth in its entirety.

FIELD OF THE INVENTIVE SUBJECT MATTER

The present inventive subject matter is directed to a lighting device that comprises one or more solid state light emitters (e.g., one or more light emitting diodes) and at least one light emitter positioning element on which the solid state light emitter(s) is/are positioned. In some aspects, the present inventive subject matter is directed to such lighting devices in which at least a portion of the light emitter positioning element is of a spiral shape. In some aspects, the present inventive subject matter is directed to such lighting devices which further comprise a support structure that comprises a ledge of a spiral shape, and at least a portion of the at least one light emitter positioning element is in contact with the ledge.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

A challenge with solid state light emitters is that the performance of many solid state light emitters may be reduced when they are subjected to elevated temperatures. A common manufacturer recommendation is that the junction temperature of a light emitting diode (i.e., the temperature of the semiconductor junction of the LED) should not exceed 85 degrees C. if a long lifetime is desired. Various heat sinking schemes have been developed to dissipate at least some of the heat that is generated by the LED. See, for example, Application Note: CLD-APO6.006, entitled *Cree® XLamp® YR Family* & 4550 *LED Reliability*, published at cree.com/xlamp, September 2008.

In order to encourage development and deployment of highly energy efficient solid state lighting (SSL) products to replace several of the most common lighting products currently used in the United States, including 60-watt A19 incandescent and PAR 38 halogen incandescent lamps, the Bright Tomorrow Lighting Competition (L Prize™) has been authorized in the Energy Independence and Security. Act of 2007 (EISA). The L Prize is described in "*Bright Tomorrow Lighting Competition* (*L Prize*™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, expected lifetime, dimensions and base type.

In addition, the intensity of light emitted from some solid state light emitters varies based on operating temperature, and the variance in intensity resulting from changes in operating temperature can be more pronounced for solid state light emitters that emit light of one color than for solid state light emitters that emit light of another color. For example, light emitting diodes that emit red light often have a very strong temperature dependence (e.g., AlInGaP light emitting diodes can reduce in optical output by ~20% when heated up by ~40 degrees C., that is, approximately −0.5% per degree C.; and blue InGaN+YAG:Ce light emitting diodes can reduce by about −0.15/degree C.). In many lighting devices that include solid state light emitters as light sources (e.g., general illumination devices that emit white light in which the light sources consist of light emitting diodes), a plurality of solid state light emitters are provided that emit light of different colors which, when mixed, are perceived as the desired color for the output light (e.g., white or near-white). The desire to maintain a relatively stable color of light output is therefore an important reason to try to reduce temperature variation of solid state light emitters.

Efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide solid state light emitters that are improved, e.g., with respect to energy efficiency, color rendering index (CRI Ra), efficacy (lm/W), and/or duration of service.

BRIEF SUMMARY OF THE INVENTIVE SUBJECT MATTER

Currently, there exist solid state lighting devices that use multiple light emitting diodes in close proximity to each other. For example, the MXP from Cree, Inc. (Durham, N.C.) provides an array of small LEDs in a device that is approximately three quarters of an inch in diameter. Other lighting devices, such as the LR4 and the LR6 from Cree, Inc. provide LEDs on a single metal core PC board arranged in an array that is about three inches in diameter. The largest array of LEDs utilized in a lighting product from Cree, Inc. is in the LR24 which includes an LED board that is about ten inches square. All of these products provide LEDs on a single planar (or substantially planar) board.

In some aspects, the present inventive subject matter provides for the distribution of solid state light emitters throughout a large portion of a lighting device. Such a distribution may thermally isolate (or substantially isolate) some or all of the solid state light emitters from each other. In some embodiments, solid state light emitters can be distributed in three dimensional arrangements, such as cones or spirals. Some aspects in accordance with the present inventive subject matter can allow for simpler fabrication and improved heat dissipation from the solid state light emitters. In addition, some aspects in accordance with the present inventive subject matter can allow for controlling the distribution (including the overall shape(s) and the direction(s)) of light exiting the lighting device.

In one aspect of the present inventive subject matter, there is provided a lighting device comprising at least a first light emitter positioning element.

In one aspect of the present inventive subject matter, there is provided a lighting device comprising at least a first light emitter positioning element and at least first and second solid state light emitters.

In another aspect of the present inventive subject matter, there is provided a light emitter positioning element that is of a spiral shape.

In another aspect of the present inventive subject matter, there is provided a lighting device comprising at least a first light emitter positioning element, at least first and second solid state light emitters, and a support structure.

In another aspect of the present inventive subject matter, there is provided a lighting device comprising:

at least a first light emitter positioning element; and at least a first solid state light emitter and a second solid state light emitter, the first and second solid state light emitters being positioned on the first light emitter positioning element, at least a first portion of the first light emitter positioning element being of a spiral shape.

In another aspect of the present inventive subject matter, there is provided a lighting device comprising:

at least a first light emitter positioning element;

at least a first solid state light emitter and a second solid state light emitter, the first and second solid state light emitters being positioned on the first light emitter positioning element; and a support structure, at least a portion of the first light emitter positioning element being in contact with the ledge.

In some of such embodiments:

at least a first portion of the first light emitter positioning element is of a spiral shape, and/or the support structure comprises a ledge of a spiral shape.

In another aspect of the present inventive subject matter, there is provided a method of assembling a lighting device, comprising:

positioning a first light emitter positioning element so that at least part of the first light emitter positioning element is in contact with a support structure, at least a first solid state light emitter and a second solid state light emitter being positioned on the first light emitter positioning element, the support structure comprising a ledge; and pressing at least a first portion of the first light emitter positioning element to bring the first light emitter positioning element into contact with the ledge.

In some of such embodiments, at least a first portion of the first light emitter positioning element is of a spiral shape, and/or at least a first region of the ledge is of a spiral shape.

According to another aspect of the present inventive subject matter, there is provided a lighting device, comprising:

at least first and second solid state light emitters; and means for dissipating heat (e.g., at least a first light emitter positioning element as described herein).

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
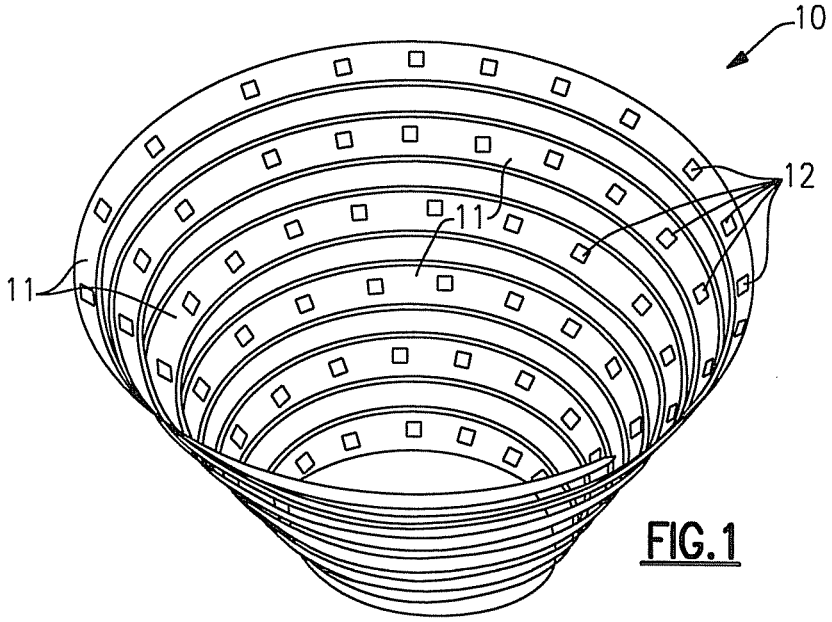
FIG. 1 is a perspective view of a lighting device 10 according to the present inventive subject matter.

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being positioned "on", being mounted "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top", "above," "horizontal" or "vertical" may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The term "illumination" (or "illuminated"), as used herein means that a light source is emitting electromagnetic radiation. For example, when referring to a solid state light emitter, the term "illumination" means that at least some current is being supplied to the solid state light emitter to cause the solid state light emitter to emit at least some electromagnetic radiation (in some cases, with at least a portion of the emitted radiation having a wavelength between 100 nm and 1000 nm, and in some cases within the visible spectrum). The expression "illuminated" also encompasses situations where the light source emits light continuously or intermittently at a rate such that if it is or was visible light, a human eye would perceive it as emitting light continuously (or discontinuously), or where a plurality of light sources (especially in the case of solid state light emitters) that emit light of the same color or different colors are emitting light intermittently and/or alternatingly (with or without overlap in "on" times) in such a way that if they were or are visible light, a human eye would perceive them as emitting light continuously or discontinuously (and, in cases where different colors are emitted, as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

As noted above, some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

The expression "substantially transparent", as used herein, means that the structure which is characterized as being substantially transparent allows passage of at least 90% of incident visible light.

The expression "substantially translucent", as used herein, means that at least 95% of the structure which is characterized as being substantially translucent allows passage of at least some light.

The term "reflective", as used herein, means that at least 75% of a portion of a surface of a structure (or region of a structure) that is characterized as being reflective reflects at least 70% of incident visible light.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As discussed above, some aspects of the present inventive subject matter relate to a lighting device that comprises at least one light emitter positioning element of a spiral shape and one or more solid state light emitters. At least a portion of the first light emitter positioning element (and in some embodiments, the entirety of the first light emitter positioning element) can be of any suitable spiral shape, some of which are described below.

The expression "spiral shape" is used herein in accordance with its well known meaning, i.e., it refers to a shape that has at least a first end and a second end, and in which traveling along the spiral shape in the most direct route from the first end to the second end would result in winding around a pole and gradually receding from the pole (e.g., an axis). A spiral shape can be a flat spiral shape or a non-flat spiral shape.

In the case of a "flat spiral shape", at least a first surface of the spiral shape is substantially planar, and for at least 50% of the 360 degree windings (in some instances, at least 75%, at least 90%, at least 95% or all) about the pole (or an axis that is perpendicular to the plane in which all the points in the flat spiral shape are located), at least one location along the most direct route (from the first end to the second end) in at least 50% (in some instances, at least 75%, at least 90%, at least 95% or all) of the 45 degree angular regions (in some instances, 20 degree angular regions, 10 degree angular regions, and in some instances, 5 degree, 3 degree, 2 degree or 1 degree angular regions) is farther from the pole (or the axis) than at least one location on the spiral shape at the same angular region during the previous 360 degree winding. The "20 degree angular regions" as used in the previous sentence would be the 18 equal pie-shaped regions of a "pie" oriented perpendicularly to the pole (or the axis).

In the case of a "non-flat spiral shape", the spiral shape is not substantially planar, and so if a first perpendicular plane is defined perpendicular to the pole and intersecting the pole at a first end of the spiral shape, and if a set of longitudinal planes are defined which each include the pole (or an axis of the pole) and which are each oriented at different angles relative to each other and spaced evenly from its adjacent neighbors by 45 degrees (or 20 degrees, 10 degrees, 5 degrees, 3 degrees, 2 degrees or 1 degree), to define 8 equal 45 degree angular regions (or 18 equal 20 degree angular regions, 36 equal 10 degree angular regions, 72 equal 5 degree angular regions, 120 equal 3 degree regions, 180 equal 2 degree regions or 360 equal 1 degree regions), for at least one point in at least 50% (in some instances, at least 75%, at least 90%, at least 95% or all) of the angular regions of at least 50% of the 360 degree windings around the pole (in some instances, at least 75%, at least 90%, at least 95% or all of the windings), the farther the distance from that point to the first perpendicular plane, the farther the distance from that point to the pole (or the axis of the pole).

As can be inferred from the definitions relating to "spiral shapes" as set forth above, spiral shapes, as defined herein, are not limited to only shapes that could be defined by winding a wire around a conical shape or a frustoconical shape, but instead they also encompass shapes that could be defined by winding a wire around pyramidal or frustopyramidal shapes or by winding a wire around any other regular or irregular shapes where for each 360 degree winding about the axis of the regular shape or the pole of the irregular shape, at least some positions within angular regions along the winding are farther from the pole (or the axis of the pole) than in respective angular regions during the previous 360 degree winding.

The expression "pole", as used herein, means an axis for a regular shape or, for an irregular shape, a line for which an equal weight of the irregular shape is contained in each 20 degree angular region defined relative to the line (or for which an equal weight could be contained in each 45 degree angular region by adding to, or removing from, a specific location or locations mass that in total comprises not more than about 20 percent of the mass of the structure).

The expression "closed spiral shape", as used herein, means a spiral shape in which for at least 180 degrees (or at least 270 degrees, or at least 315 degrees, or all 360 degrees) of at least 50% of all of the 360 degree windings (or at least 75% of all of the 360 degree windings, or at least 90% of all of the 360 degree windings, or at least 95% of all of the 360 degree windings, or all of the 360 degree windings), a portion of the first light emitter positioning element is in contact with a portion of the first light emitter positioning element from the previous 360 degree winding.

The expression "open spiral shape", as used herein, means a spiral shape that is not a closed spiral shape, as defined above.

The expression "interwoven", as used herein when referring to at least respective portions of at least first and second spiral light emitter positioning elements, means that:

if a first perpendicular plane is defined perpendicular to a pole of one or more of the light emitter positioning elements and intersecting the pole at a first end of the spiral shape of one or more of the light emitter positioning elements, and if a set of longitudinal planes are defined which each include the pole (or an axis of the pole) and which are each oriented at different angles relative to each other and spaced evenly from its neighbors by 45 degrees (or 20 degrees, 10 degrees, 5 degrees, 3 degrees, 2 degrees or 1 degree), to define 8 equal 45 degree angular regions (or 18 equal 20 degree angular regions, 36 equal 10 degree angular regions, 72 equal 5 degree angular regions, 120 equal 3 degree regions, 180 equal 2 degree regions or 360 equal 1 degree regions), in each of at least two 360 degree windings of the first and second spiral light emitter positioning elements, in at least 50% (in some instances, at least 75%, at least 90%, at least 95% or all) of the angular regions:

a first location on the first spiral light emitter positioning element is spaced from the pole by a distance that is between respective distances by which first and second locations on the second spiral light emitter positioning element are spaced from the pole, and the first location on the first spiral light emitter positioning element is spaced from the first perpendicular plane (1) by a distance that is between respective distances by which the first and second locations on the second spiral light emitter positioning element are spaced from the first perpendicular plane, or (2) by a distance that is equal to one or both of the respective distances by which the first and second locations on the second spiral light emitter positioning element are spaced from the first perpendicular plane.

The first light emitter positioning element can be made of any suitable material or materials, and can be of any suitable shape.

In some embodiments, the first light emitter positioning element is in the shape of a strip that has a width that is comparatively smaller than its length, whereby a first end of the first light emitter positioning element is at one end of its length, and a second end of the first light emitter positioning element is at an opposite end of its length, and the first light emitter positioning element is formed into a spiral shape between the two ends.

In some embodiments, along its length, the first light emitter positioning element comprises a base and one or more conductive regions formed on the base. In such embodiments, the base can be made of any suitable material or materials, a wide variety of which are known to, and readily available to, those of skill in the art, e.g., any material (or combination of materials) used to make circuit boards, e.g., a plastic material. In some of such embodiments, the base can comprise a base support (made of any suitable material, e.g., aluminum) and a base coating (made of any suitable electrically insulating material, e.g., plastic), In embodiments that comprise a base and one or more conductive regions, the one or more conductive regions can be made of any suitable material or materials, a wide variety of which are known to, and readily available to, those of skill in the art, e.g., any material (or combination of materials) used to make the conductive portions (e.g., conductive traces and/or wire bonds and/or terminals) on circuit boards, e.g., aluminum or copper.

In some embodiments, electrically conductive traces are formed on the first light emitter positioning element, and for at least one solid state light emitter, a positive contact of the solid state light emitter is electrically connected (e.g., with a wire bond) to a first trace, and a negative contact of the solid state light emitter is electrically connected (e.g., with a wire bond) to a second trace.

In some embodiments, electrically conductive traces are formed on the first light emitter positioning element, and for at least one solid state light emitter, the solid state light emitter is mounted on a first trace, and the solid state light emitter is electrically connected to a second trace (e.g., with a wire bond).

In some embodiments, at least some solid state light emitters are electrically connected in series, in which for each of at least one solid state light emitter, a positive contact is electrically connected to one solid state light emitter (e.g., with a first wire bond), and a negative contact is electrically connected to another solid state light emitter (e.g., with a second wire bond).

In some embodiments, electrically conductive traces are formed on the first light emitter positioning element, and for at least one solid state light emitter, the solid state light emitter is positioned such that a first region of the solid state light emitter is on a first conductive trace and a second region of the solid state light emitter is on a second conductive trace, the positive contact of the solid state light emitter is electrically connected (e.g., with a wire bond) to the first conductive trace, the negative contact of the solid state light emitter is electrically connected (e.g., with a wire bond) to the second conductive trace, and an extended portion of the first light emitter positioning element extends toward a third region of the solid state light emitter (and optionally is in contact with the third region of the solid state light emitter), whereby heat can be more effectively be transferred from the third region of the solid state light emitter to the first light emitter positioning element than if the extended portion of the first light emitter positioning element were not present.

In some embodiments, a positive track and a negative track can be provided on the first light emitter positioning element, and for at least one of the solid state light emitters, a positive contact of the solid state light emitter is electrically connected to the positive track and a negative contact of the solid state light emitter is electrically connected to the negative track.

In some embodiments, a positive track and a negative track can be provided on the first light emitter positioning element, and for at least two of the solid state light emitters, a positive contact of the solid state light emitter is electrically connected (e.g., by direct contact or with a wire bond) to the positive track and a negative contact of the solid state light emitter is electrically connected (e.g., by direct contact or with a wire bond) to the negative track, whereby the two or more solid state light emitters are electrically connected in parallel.

A number of representative specific embodiments of suitable first light emitter positioning elements are described below, any of which (or any portion of which) can be employed, in addition to a wide variety of other arrangements that skilled artisans would recognize as being suitable for positioning the solid state light emitters.

In some embodiments, at least a portion of the first light emitter positioning element is in the shape of an open spiral shape, and in some embodiments, the entirety of the first light emitter positioning element is in the shape of an open spiral shape.

In some embodiments, at least a portion of the first light emitter positioning element is in the shape of a closed spiral shape, and in some embodiments, the entirety of the first light emitter positioning element is in the shape of a closed spiral shape.

In some embodiments, at least a portion of the first light emitter positioning element is in the shape of a flat spiral shape, and in some embodiments, the entirety of the first light emitter positioning element is in the shape of a flat spiral shape.

In some embodiments, at least a portion of the first light emitter positioning element is in the shape of a non-flat spiral shape, and in some embodiments, the entirety of the first light emitter positioning element is in the shape of a non-flat spiral shape.

In some embodiments, the lighting device further comprises at least a second light emitter positioning element, and the first and second light emitter positioning elements are at least partially interwoven. In some of such embodiments, at least a portion of the second light emitter positioning element is of a spiral shape.

In some embodiments, at least a portion of the first light emitter positioning element is reflective.

In some embodiments, at least a portion of the first light emitter positioning element is transparent.

A variety of solid state light emitters are well known, and any of such light emitters can be employed according to the present inventive subject matter. Representative examples of solid state light emitters include light emitting diodes (inorganic or organic, including polymer light emitting diodes (PLEDs)) (with or without luminescent materials) and thin film electroluminescent devices.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) (and/or the type of electromagnetic radiation, e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode. The at least one solid state light emitter in the lighting devices according to the present inventive subject matter can comprise one or more chips positioned on the first light emitter positioning element and/or one or more packaged devices positioned on the first light emitter positioning element.

Lighting devices or lighting arrangements according to the present inventive subject matter can, if desired, further comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

The one or more solid state light emitters (and optionally one or more luminescent materials) can be arranged in any suitable way.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009/0296384), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

The at least one solid state light emitter can be positioned on the first light emitter positioning element in any suitable arrangement.

In embodiments that comprise three or more solid state light emitters positioned on the first light emitter positioning element, the solid state light emitters can be substantially evenly spaced. For example, in some of such embodiments, for each of at least 50% of the solid state light emitters (and in some embodiments, 60%, 70%, 80%, 90% or 100%), the spacing between the solid state light emitter and the nearest other solid state light emitter is within 20% of a specific distance (and in some embodiments, within 15%, 10%, 7%, 5%, 3%, 2% or less of a specific distance).

In embodiments that comprise two or more solid state light emitters positioned on the first light emitter positioning element, the solid state light emitters can be positioned in a linear or non-linear arrangement (e.g., before the first light emitter positioning element is coiled into a spiral shape).

In embodiments that comprise two or more solid state light emitters positioned on the first light emitter positioning element, all of the solid state light emitters can be on one side of the first light emitter positioning element, or one or more of the solid state light emitters can be on one side of the first light emitter positioning element and one or more of the solid state light emitters can be on another side of the first light emitter positioning element.

The solid state light emitters (or the solid state light emitter) can be arranged relative to the first light emitter positioning element such that some or all of the solid state light emitters are not obscured by the first light emitter positioning element, or are at least partially obscured by at least a portion of one or more of the windings of the spiral shape of the first light emitter positioning element. In any such devices, especially those in which at least some of the solid state light emitters are at least partially obscured by at least a portion of one or more of the windings of the spiral shape of the first light emitter positioning element, at least a portion of the first light emitter positioning element (e.g., at least one or more regions of one or more of the windings of the first light emitter positioning element can be reflective and can reflect light from the one or more solid state light emitters.

In some embodiments according to the present inventive subject matter, the first light emitter positioning element can be shaped and oriented, and/or the one or more solid state light emitters can be positioned relative to the first light emitter positioning element, to allow for control of the pattern of emitted light and may be adjusted to provide improved thermal dissipation.

In some embodiments, some or all of the solid state light emitters can be placed on the first light emitter positioning element when the first light emitter positioning element is in a spiral shape.

In some embodiments, some or all of the solid state light emitters can be placed on the first light emitter positioning element before the first light emitter positioning element is formed into a spiral shape. For instance, one or more solid state light emitters can be placed on the first light emitter positioning element while the first light emitter positioning element is in a substantially rectangular shape (e.g., a substantially rectangular shape that is considerably longer than it is wide, such as a tape structure), after which the first light emitter positioning element (with the one or more solid state light emitters positioned thereon) can be twisted into a spiral shape.

The one or more solid state light emitters can be attached to the first light emitter positioning element in any suitable way, persons of skill in the art being familiar with a variety of ways to attach solid state light emitters to another structure. For example, persons of skill in the art are familiar with, and have access to, a variety of adhesive materials and combinations of materials.

In some embodiments, one or more solid state light emitters can be placed on a thermally conductive tape (which can, if desired, also include electrically conductive regions, e.g., traces), which can later be applied to the first light emitter positioning element. Persons of skill in the art are familiar with a variety of materials out of which such a tape could be made.

In some embodiments, one or more regions of at least the first light emitter positioning element can be work hardened. Work hardening a region (or regions) of a light emitter positioning element can result in that region (or regions) being less susceptible to changes in shape when the light emitter positioning element is later bent, e.g., when forming it into a spiral shape (e.g., changing it from a rectangular shape to a spiral shape). Persons of skill in the art are familiar with ways to perform work hardening. In general, work hardening involves processing a material so that it becomes softened. For example, annealing a material normally softens a material, as does applying pressure (e.g., by bending it). In some embodiments, (1) with a light emitter positioning element arranged in a generally rectangular shape, (a) one or more solid state light emitters are mounted on the light emitter positioning element, (b) conductive traces are formed on the light emitter positioning element, and (c) wire bonds are formed to electrically connect the solid state light emitters to the conductive traces, and then (2) the light emitter positioning element is bent into a spiral shape, and in such embodiments, prior to mounting the solid state light emitters on the light emitter positioning element, the light emitter positioning element can be work hardened in at least one region where a solid state light emitter will later be mounted and/or where a wire bond will be formed, so that less deformation will occur at that region (or those regions) to avoid or reduce the incidence of damage to the solid state light emitter(s) and/or wire bond(s) when the light emitter positioning element is bent into a spiral shape.

As noted above, an aspect of the present inventive subject matter relates to a lighting device that further comprises a support structure. As also noted above, in some embodiments of lighting devices that comprise a support structure, the support structure comprises a ledge of a spiral shape, and at least a portion of the first light emitter positioning element is in contact with the ledge.

The support structure can be made out of any suitable material or materials, and skilled, artisans are familiar with a wide variety of materials that could be employed. For example, the support structure can be made of steel, aluminum or any other material or materials. In some embodiments, the support structure comprises at least one thermally conductive material.

The support structure can be made by stamping, forging, casting, molding or otherwise fabricating. Alternatively, the support structure could be created by rolling a sheet of metal (optionally, the sheet could be pre-cut), such as steel or aluminum.

In some embodiments, at least a portion of the support structure is highly reflective (either specular or diffuse). A diffuse reflector may allow for improved mixing from the solid state light emitters, but in some cases, it might adversely affect light control.

In some embodiments, the distribution of the solid state light emitters can allow for control of the thermal aspects and light distribution aspects of the lighting device.

In some embodiments, at least a portion of the support structure is transparent or translucent.

In some embodiments, holes can be provided in the support structure to allow light to be distributed in directions other than the forward direction.

In some embodiments, the solid state light emitters are spaced substantially evenly relative to the support structure, e.g., such that for each of at least 50% of the solid state light emitters (or in some embodiments at least 60%, at least 70%, at least 80%, at least 90% or 100% of the solid state light emitters), the surface area of an inside of the support structure that is closest to that solid state light emitter is within 10% (or in some embodiments within 20%) of a particular value.

Some embodiments in accordance with the present inventive subject matter (which can include or not include any of the features described elsewhere herein) include one or more lenses, diffusers or light control elements. Persons of skill in the art are familiar with a wide variety of lenses, diffusers and light control elements, can readily envision a variety of materials out of which a lens, a diffuser, or a light control element can be made, and are familiar with and/or can envision a wide variety of shapes that lenses, diffusers and light control elements can be. Any of such materials and/or shapes can be employed in a lens and/or a diffuser and/or a light control element in an embodiment that includes a lens and/or a diffuser and/or a light control element. As will be understood by persons skilled in the art, a lens or a diffuser or a light control element in a lighting device according to the present inventive subject matter can be selected to have any desired effect on incident light (or no effect), such as focusing, diffusing, etc. Any such lens and/or diffuser and/or light control element can comprise one or more luminescent materials, e.g., one or more phosphor.

In embodiments in accordance with the present inventive subject matter that include a lens (or plural lenses), the lens (or lenses) can be positioned in any suitable location and orientation.

In embodiments in accordance with the present inventive subject matter that include a diffuser (or plural diffusers), the diffuser (or diffusers) can be positioned in any suitable location and orientation. In some embodiments, which can include or not include any of the features described elsewhere herein, a diffuser can be provided over a top or any other part of the lighting device, and the diffuser can comprise one or more luminescent material (e.g., in particulate form) spread throughout a portion of the diffuser or an entirety or the diffuser.

In embodiments in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed. For example, representative light control elements are described in U.S. Patent Application No. 61/245,688, filed on Sep. 25, 2009, the entirety of which is hereby incorporated by reference as if set forth in its entirety.

In addition, one or more scattering elements (e.g., layers) can optionally be included in the lighting devices according to the present inventive subject matter. For example, a scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

The lighting devices of the present inventive subject matter can be arranged, mounted and supplied with electricity in any desired manner, and can be mounted on any suitable housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present inventive subject matter.

Representative examples of arrangements of lighting devices, schemes for mounting lighting devices, apparatus for supplying electricity to lighting devices, housings for lighting devices and fixtures for lighting devices, all of which are suitable for the lighting devices of the present inventive subject matter, are described in U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/467,467, filed on May 18, 2009 (now U.S. Patent Publication No. 2010/0290222), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/465,203 May 13, 2009, filed on May 13, 2009 (now U.S. Patent Publication No. 2010/0290208), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety;

U.S. patent application Ser. No. 12/566,936, filed on Sep. 25, 2009 (now U.S. Patent Publication No. 2011/0075423), the entirety of which is hereby incorporated by reference as if set forth in its entirety;

U.S. patent application Ser. No. 12/566,857, filed on Sep. 25, 2009 (now U.S. Patent Publication No. 2011/0075411), the entirety of which is hereby incorporated by reference as if set forth in its entirety; and U.S. patent application Ser. No. 12/566,861, filed on Sep. 25, 2009 (now U.S. Patent Publication No. 2011/0075422), the entirety of which is hereby incorporated by reference as if set forth in its entirety.

In some embodiments in accordance with the present inventive subject matter, the lighting device can emit light in all directions, while in other embodiments, the lighting device can emit light in fewer than all directions (as a result of the shape of the lighting device and/or the nature of the lighting device, and/or as a result of a shade positioned relative to the lighting device, and/or as a result of some other angular control of the light emanating from the lighting device).

In some embodiments, one or more thermal elements can be provided, at least one of which is in a location where it can serve a specific solid state light emitter or group of solid state light emitters. A representative example of a suitable thermal element is a projection that extends from a light emitter positioning element, and/or from a support structure (and/or from a housing) on a side that is opposite a side on which the solid state light emitter(s) is/are mounted (or which is on a side that is opposite a side that faces the location where the solid state light emitter(s) is positioned. Alternatively or additionally, a portion of the heat sink adjacent to the solid state light emitter (or solid state light emitters) can be removed (and optionally can be filled with a thermal element or a part of a thermal element). A thermal element can be made of any suitable material, and can be of any suitable shape. Use of materials having higher heat conductivity in making the thermal element(s) generally provides greater heat transfer, and use of thermal element(s) of larger surface area and/or cross-sectional area generally provides greater heat transfer. Representative examples of materials that can be used to make the thermal element(s), if provided, include metals, diamond, DLC, etc.

The lighting devices according to the present inventive subject matter can be incorporated in devices designed so as to serve any of a variety of functions (e.g., as a flood light, as a spotlight, as a downlight, etc.), for residential, commercial or other applications.

Any desired circuitry (including any desired electronic components) can be employed in order to supply energy to the one or more solid state light emitters in the lighting devices according to the present inventive subject matter. Representative examples of circuitry which may be used is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety;

U.S. patent application Ser. No. 12/328,115, filed on Dec. 4, 2008 (now U.S. Patent Publication No. 2009-0184662), the entirety of which is hereby incorporated by reference as if set forth in its entirety;

U.S. patent application Ser. No. 12/566,142, filed on Sep. 24, 2009, entitled "Solid State Lighting Apparatus With Configurable Shunts" (now U.S. Patent Publication No. 2011-0068696), the entirety of which is hereby incorporated by reference as if set forth in its entirety; and U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011-0068702), the entirety of which is hereby incorporated by reference as if set forth in its entirety.

The lighting devices according to the present inventive subject matter can further comprise a power supply and/or a driver. For example, solid state lighting systems have been developed that include a power supply that receives the AC line voltage and converts that voltage to a voltage (e.g., to DC and to a different voltage value) and/or current suitable for driving solid state light emitters. Typical power supplies for light emitting diode light sources include linear current regulated supplies and/or pulse width modulated current and/or voltage regulated supplies.

A driver can comprise one or more electrical components employed in driving one or more light source, e.g., running one or more light source intermittently and/or adjusting the current supplied to one or more light sources in response to a user command, a detected change in intensity or color of light output, a detected change in an ambient characteristic such as temperature or background light, etc., and/or a signal contained in the input power (e.g., a dimming signal in AC power supplied to the lighting device).

A driver can include any of a variety of components, for example, (1) one or more electrical components employed in converting electrical power (e.g., from AC to DC), (2) one or more electrical components employed in driving one or more light source, e.g., running one or more light source intermittently and/or adjusting the current supplied to one or more light sources in response to a user command, a detected change in intensity or color of light output, a detected change in an ambient characteristic such as temperature or background light, etc., and/or a signal contained in the input power (e.g., a dimming signal in AC power supplied to the lighting device), etc., (3) one or more circuit boards (e.g., a metal core circuit board) for supporting any electrical components, (4) one or more wires connecting any components (e.g., connecting an Edison socket to a circuit board), etc.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Berg Johansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

Various types of electrical connectors are well known to those skilled in the art, and any of such electrical connectors can be used in the lighting devices according to the present inventive subject matter. Representative examples of suitable types of electrical connectors include Edison plugs (which are receivable in Edison sockets) and GU24 pins (which are receivable in GU24 sockets).

The electrical connector, when included, can be electrically connected to the solid state light emitters in any suitable way. A representative example of a way to electrically connect a solid state light emitter to an electrical connector is to connect a first portion of a flexible wire to the electrical connector and to connect a second portion of the flexible wire to a circuit board (e.g., a metal core circuit board) on which a driver is mounted, and to attach a first portion of a second flexible wire to the output from the driver and to attach a second portion of the second flexible wire to a circuit board on which the solid state light emitters are mounted.

Some embodiments in accordance with the present inventive subject matter (which can include or not include any of the features described elsewhere herein) can comprise a power line that can be connected to a source of power (such as a branch circuit, a battery, a photovoltaic collector, etc.) and that can supply power to an electrical connector (or directly to the lighting device). Persons of skill in the art are familiar with, and have ready access to, a variety of structures that can be used as a power line. A power line can be any structure that can carry electrical energy and supply it to an electrical connector on a fixture element and/or to a lighting device according to the present inventive subject matter.

Energy can be supplied to the lighting devices according to the present inventive subject matter from any source or combination of sources, for example, the grid (e.g., line voltage), one or more batteries, one or more photovoltaic energy collection device (i.e., a device that includes one or more photovoltaic cells that convert energy from the sun into electrical energy), one or more windmills, etc.

In general, light of any number of colors can be mixed by the lighting devices according to the present inventive subject matter. Representative examples of blending of light colors are described in:

U.S. patent application Ser. No. 11/613,714, filed Dec. 20, 2006 (now U.S. Patent Publication No. 2007/0139920), the entirety of which is hereby incorporated by reference as if set forth in its entirety;

U.S. patent application Ser. No. 11/613,733, filed Dec. 20, 2006 (now U.S. Patent Publication No. 2007/0137074) the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/736,799, filed Apr. 18, 2007 (now U.S. Patent Publication No. 2007/0267983), the entirety of which is hereby incorporated by reference as if set forth in its entirety;

U.S. patent application Ser. No. 11/737,321, filed Apr. 19, 2007 (now U.S. Patent Publication No. 2007/0278503), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 12/117,122, filed May 8, 2008 (now U.S. Patent Publication No. 2008/0304260), the entirety of which is hereby incorporated by reference as if set forth in its entirety;

U.S. patent application Ser. No. 12/117,131, filed May 8, 2008 (now U.S. Patent Publication No. 2008/0278940), the entirety of which is hereby incorporated by reference as if set forth in its entirety;

U.S. patent application Ser. No. 12/117,136, filed May 8, 2008 (now U.S. Patent Publication No. 2008/0278928), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009/0296384), the entirety of which is hereby incorporated by reference as if set forth in its entirety;

U.S. patent application Ser. No. 12/248,220, filed on Oct. 9, 2008 (now U.S. Patent Publication No. 2009/0184616), the entirety of which is hereby incorporated by reference as if set forth in its entirety;

U.S. patent application Ser. No. 11/951,626, filed Dec. 6, 2007 (now U.S. Patent Publication No. 2008/0136313), the entirety of which is hereby incorporated by reference as if set forth in its entirety;

U.S. patent application Ser. No. 12/035,604, filed on Feb. 22, 2008 (now U.S. Patent Publication No. 2008/0259589), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety;

U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley), the entirety of which is hereby incorporated by reference as if set forth in its entirety; and U.S. patent application Ser. No. 12/535,319, filed on Aug. 4, 2009 (now U.S. Patent Publication No. 2011/0031894), the entirety of which is hereby incorporated by reference as if set forth in its entirety.

The lighting devices according to the present inventive subject matter can further comprise elements that help to ensure that the perceived color (including color temperature) of the light exiting the lighting device is accurate (e.g., within a specific tolerance). A wide variety of such elements and combinations of elements are known, and any of them can be employed in the lighting devices according to the present inventive subject matter. For instance, representative examples of such elements and combinations of elements are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

Some embodiments of the present inventive subject matter, which can include or not include any of the features described elsewhere herein, can comprise one or more controllers configured to control a ratio of light emitted by at least one light emitter and light emitted by at least a second light emitter such that a combination of the light is of a desired color point.

A controller may be a digital controller, an analog controller or a combination of digital and analog. For example, the controller may be an application specific integrated circuit (ASIC), a microprocessor, a microcontroller, a collection of discrete components or combinations thereof. In some embodiments, the controller may be programmed to control the lighting devices. In some embodiments, control of the lighting devices may be provided by the circuit design of the controller and is, therefore, fixed at the time of manufacture. In still further embodiments, aspects of the controller circuit, such as reference voltages, resistance values or the like, may be set at the time of manufacture so as to allow adjustment of the control of the lighting devices without the need for programming or control code.

Representative examples of suitable controllers are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety; and U.S. patent application Ser. No. 12/257,804, filed on Oct. 24, 2008 (now U.S. Patent Publication No. 2009/0160363), the entirety of which is hereby incorporated by reference as if set forth in its entirety.

Some embodiments in accordance with the present inventive subject matter (which can include or not include any of the features described elsewhere herein) can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

In some embodiments according to the present inventive subject matter, the lighting device emits at least 600 lumens, and in some embodiments at least 750 lumens, at least 900 lumens, at least 1000 lumens, at least 1100 lumens, at least 1200 lumens, at least 1300 lumens, at least 1400 lumens, at least 1500 lumens, at least 1600 lumens, at least 1700 lumens, at least 1800 lumens (or in some cases at least even higher lumen outputs), and/or CRI Ra of at least 70, and in some embodiments at least 80, at least 85, at least 90 or at least 95) when the lighting device is energized (e.g., by supplying line voltage to the lighting device).

In some aspects of the present inventive subject matter, which can include or not include any of the features described elsewhere herein, there are provided lighting devices that emit light in a desired range of directions, e.g., substantially omnidirectionally or in some other desired pattern.

The lighting devices according to the present inventive subject matter can direct light in generally any desired range of directions. For instance, in some embodiments, the lighting device can direct light substantially omnidirectionally (i.e., substantially 100% of all directions extending from a center of the lighting device), i.e., within a volume defined by a two-dimensional shape in an x, y plane that encompasses rays extending from 0 degrees to 180 degrees relative to the y axis (i.e., 0 degrees extending from the origin along the positive y axis, 180 degrees extending from the origin along the negative y axis), the two-dimensional shape being rotated 360 degrees about the y axis (in some cases, the y axis can be a vertical axis of the lighting device). In some embodiments, the lighting device emits light substantially in all directions within a volume defined by a two-dimensional shape in an x, y plane that encompasses rays extending from 0 degrees to 150 degrees relative to the y axis (extending along a vertical axis of the lighting device), the two-dimensional shape being rotated 360 degrees about the y axis. In some embodiments, the lighting device emits light substantially in all directions within a volume defined by a two-dimensional shape in an x, y plane that encompasses rays extending from 0 degrees to 120 degrees relative to the y axis (extending along a vertical axis of the lighting device), the two-dimensional shape being rotated 360 degrees about the y axis. In some embodiments, the lighting device emits light substantially in all directions within a volume defined by a two-dimensional shape in an x, y plane that encompasses rays extending from 0 degrees to 90 degrees relative to the y axis (extending along a vertical axis of the lighting device), the two-dimensional shape being rotated 360 degrees about the y axis (i.e., a hemispherical region). In some embodiments, the two-dimensional shape can instead encompass rays extending from an angle in the range of from 0 to 30 degrees (or from 30 degrees to 60 degrees, or from 60 degrees to 90 degrees) to an angle in the range of from 90 to 120 degrees (or from 120 degrees to 150 degrees, or from 150 degrees to 180 degrees). In some embodiments, the range of directions in which the lighting device emits light can be non-symmetrical about any axis, i.e., different embodiments can have any suitable range of directions of light emission, which can be continuous or discontinuous (e.g., regions of ranges of emissions can be surrounded by regions of ranges in which light is not emitted). In some embodiments, the lighting device can emit light in at least 50% of all directions extending from a center of the lighting device (e.g., hemispherical being 50%), and in some embodiments at least 60%, 70%, 80%, 90% or more.

Solid state light emitter lighting systems (e.g., LED lighting systems) can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

Various embodiments are described herein with reference to "expected L70 lifetime." Because the lifetimes of solid state lighting products are measured in the tens of thousands of hours, it is generally impractical to perform full term testing to measure the lifetime of the product. Therefore, projections of lifetime from test data on the system and/or light source are used to project the lifetime of the system. Such testing methods include, but are not limited to, the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein. Accordingly, the term "expected L70 lifetime" refers to the predicted L70 lifetime of a product as evidenced, for example, by the L70 lifetime projections of ENERGY STAR, ASSIST and/or a manufacturer's claims of lifetime.

Lighting devices according to some embodiments of the present inventive subject matter provide an expected L70 lifetime of at least 25,000 hours. Lighting devices according to some embodiments of the present inventive subject matter provide expected L70 lifetimes of at least 35,000 hours, and lighting devices according to some embodiments of the present inventive subject matter provide expected L70 lifetimes of at least 50,000 hours.

If desired, some embodiments of lighting devices according to the present inventive subject matter can further comprise one or more active cooling elements, a wide variety of which are known to those skilled in the art, e.g., a fan, a piezoelectric device, a device comprising a magnetorestrictive material (e.g., MR, GMR, and/or HMR materials), or any other active cooling element as described in U.S. patent application Ser. No. 12/683,886, filed on Jan. 7, 2010 (now U.S. Patent Publication No. 2011/0089830), the entirety of which is hereby incorporated by reference as if set forth in its entirety. In devices according to the present inventive subject matter that include one or more active cooling elements, typically only enough air to break the boundary layer is required to induce temperature drops of 10 to 15 degrees C. (hence, in such cases, strong 'breezes" or a large fluid flow rate (large CFM) are typically not required).

Heat transfer from one structure or region to another can be enhanced (i.e., thermal resistivity can be reduced or minimized) using any suitable material or structure for doing so, a variety of which are known to persons of skill in the art, e.g., by means of chemical or physical bonding and/or by interposing a heat transfer aid such as a thermal pad, thermal grease, graphite sheets, etc.

In some embodiments according to the present inventive subject matter, which can include or not include any of the features described elsewhere herein, a portion (or portions) of any of the one or more heat dissipation elements (or other element or elements) can comprise one or more thermal transfer region(s) that has/have an elevated heat conductivity (e.g., higher than the rest of that heat dissipation element or other element) and/or one or more elements of higher heat conducting capability (e.g., one or more wires, bars, layers, particles, regions, heat pipes and/or slivers) positioned within the heat dissipation element(s). Any such thermal transfer region(s) or elements of higher heat conducting capability, if included, can also function as one or more electrical terminals for carrying electricity and/or as one or more pathways for carrying electricity, e.g., to the one or more solid state light emitters. A thermal transfer region (or regions) can be made of any suitable material, and can be of any suitable shape. Use of materials having higher heat conductivity in making the thermal transfer region(s) generally provides greater heat transfer, and use of thermal transfer region(s) of larger surface area and/or cross-sectional area generally provides greater heat transfer. Representative examples of materials that can be used to make the thermal transfer region(s), if provided, include metals, diamond, DLC, etc. Representative examples of shapes in which the thermal transfer region(s), if provided, can be formed include bars, slivers, slices, crossbars, wires and/or wire patterns.

It would be especially desirable to provide a lighting device that comprises one or more solid state light emitters (and in which some or all of the light produced by the lighting device is generated by solid state light emitters), where the lighting device can be easily substituted (i.e., retrofitted or used in place of initially) for a conventional lamp (e.g., an incandescent lamp, a fluorescent lamp or other conventional types of lamps), for example, a lighting device (that comprises one or more solid state light emitters) that can be engaged with the same socket that the conventional lamp is engaged (a representative example being simply unscrewing an incandescent lamp from an Edison socket and threading in the Edison socket, in place of the incandescent lamp, a lighting device that comprises one or more solid state light emitters). In some aspects of the present inventive subject matter, such lighting devices are provided.

In some aspects of the present inventive subject matter, there are provided lighting devices that provide good efficiency and that are within the size and shape constraints of the lamp for which the lighting device is a replacement.

In some aspects of the present inventive subject matter, which can include or not include any of the features described elsewhere herein, there are provided lighting devices that provide sufficient lumen output (to be useful as a replacement for a conventional lamp), that provide good efficiency and that are within the size and shape constraints of the lamp for which the lighting device is a replacement. In some cases, "sufficient lumen output" means at least 75% of the lumen output of the lamp for which the lighting device is a replacement, and in some cases, at least 85%, 90%, 95%, 100%, 105%, 110%, 115%, 120% or 125% of the lumen output of the lamp for which the lighting device is a replacement.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

FIG. 1 is a perspective view of a lighting device 10 according to the present inventive subject matter. The lighting device 10 comprises a light emitter positioning element 11 and a plurality of solid state light emitters 12 (in particular, light emitting diodes) positioned on the light emitter positioning element 11. As seen in FIG. 1, the entirety of the light emitter positioning element 11 is of a spiral shape, in particular, an open, non-flat spiral shape. The light emitter positioning element 11 is reflective.

Figure 2:
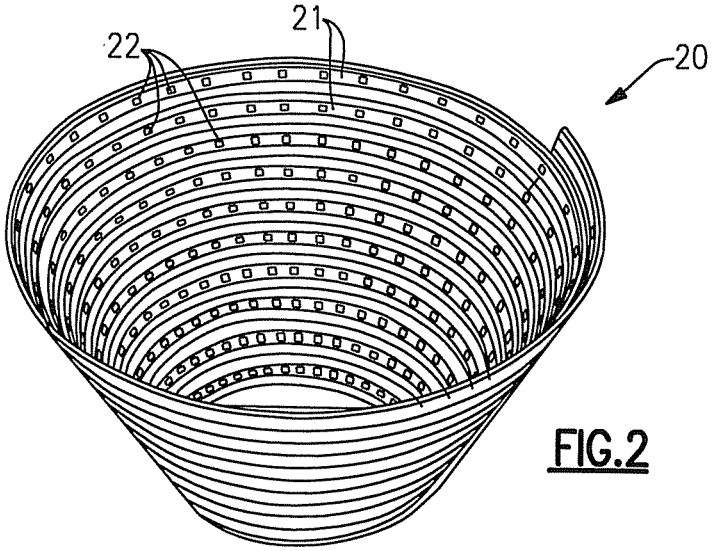
FIG. 2 is a perspective view of a lighting device 20 according to the present inventive subject matter.

FIG. 2 is a perspective view of a lighting device 20 according to the present inventive subject matter. The lighting device 20 comprises a light emitter positioning element 21 and a plurality of light emitting diodes 22 positioned on the light emitter positioning element 21. As seen in FIG. 2, the entirety of the light emitter positioning element 21 is of a spiral shape, in particular, a closed, non-flat spiral shape. The light emitter positioning element 21 is reflective.

Figure 3:
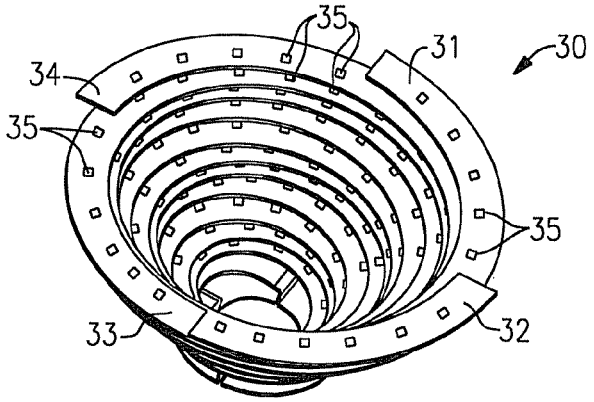
FIG. 3 is a perspective view of a lighting device 30 according to the present inventive subject matter.

FIG. 3 is a perspective view of a lighting device 30 according to the present inventive subject matter. The lighting device 30 comprises a four light emitter positioning elements 31, 32, 33 and 34, and a plurality of light emitting diodes 35 positioned on the light emitter positioning elements 31-34. As seen in FIG. 3, each of the light emitter positioning elements 31-34 is of an open, non-flat spiral shape, and the four light emitter positioning elements 31-34 are interwoven.

Figure 4:
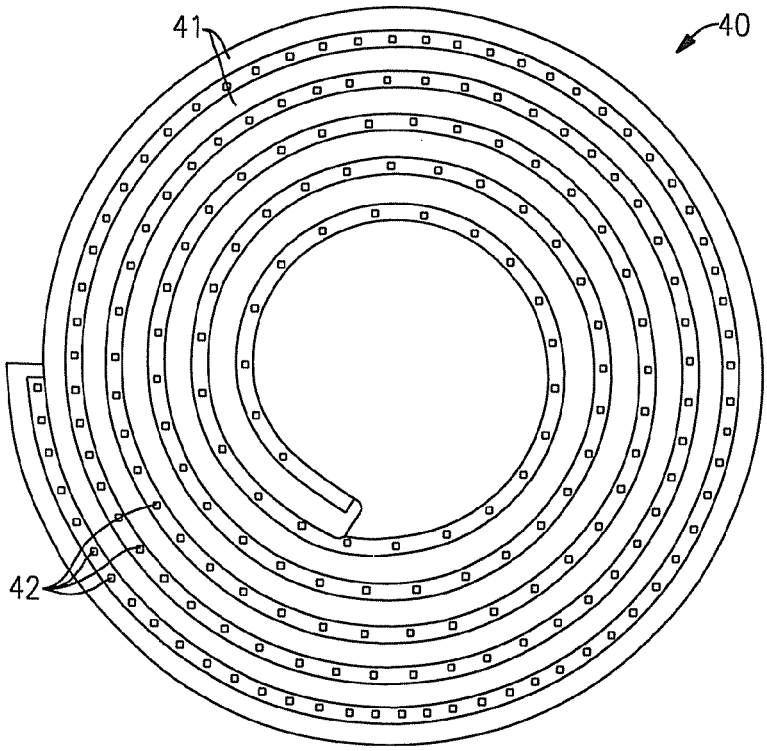
FIG. 4 is a perspective view of a lighting device 40 according to the present inventive subject matter.

FIG. 4 is a perspective view of a lighting device 40 according to the present inventive subject matter. The lighting device 40 comprises a light emitter positioning element 41 and a plurality of light emitting diodes 42 positioned on the light emitter positioning element 41. As seen in FIG. 4, the entirety of the light emitter positioning element 41 is of a closed flat spiral shape.

Figure 5:
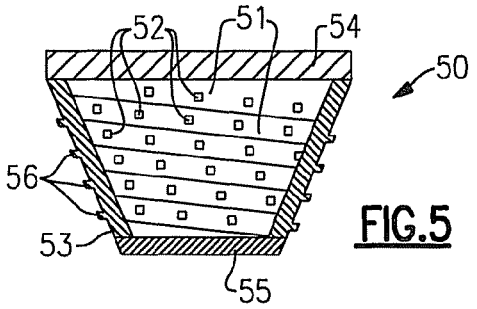
FIG. 5 is a sectional view of a lighting device 50 according to the present inventive subject matter.

FIG. 5 is a sectional view of a lighting device 50 according to the present inventive subject matter. The lighting device 50 comprises a light emitter positioning element 51, a plurality of light emitting diodes 52 positioned on the light emitter positioning element 51, a housing 53, a light control film 54 and a reflective base 55. The housing 53 comprises a plurality of fins 56 to assist in heat dissipation, the fins 56 being located adjacent to where the light emitter positioning element 51 is in contact with the housing 53. Alternatively, the element 54 can be a lens or a diffuser, or any combination of a lens, a diffuser and/or a light control element, any of which can include or can not include one or more luminescent materials.

Figure 6:
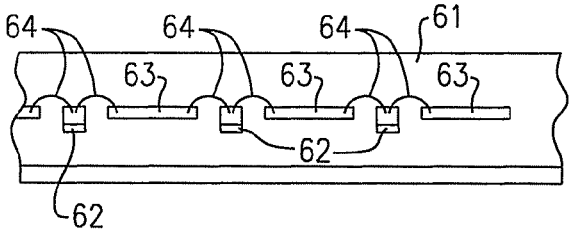
FIG. 6 is a perspective view illustrating a scheme for providing electricity to a plurality of solid state light emitters mounted on a light emitter positioning element.

FIG. 6 is a perspective view illustrating a scheme for providing electricity to a plurality of solid state light emitters 62 mounted on a light emitter positioning element 61. Referring to FIG. 6, a plurality of conductive traces 63 are formed on the light emitter positioning element 61, and for each solid state light emitter 62, one wire 64 electrically connects the anode to the conductive trace 63 to one side of the solid state light emitter 62 and another wire 64 electrically connects the cathode to the conductive trace 63 to the other side of the solid state light emitter 62, whereby the solid state light emitters 62 are electrically connected in series.

Figure 7:
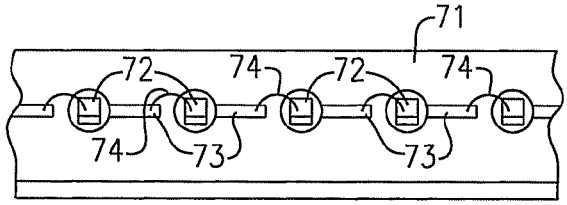
FIG. 7 is a perspective view illustrating another scheme for providing electricity to a plurality of solid state light emitters mounted on a light emitter positioning element.

FIG. 7 is a perspective view illustrating another scheme for providing electricity to a plurality of solid state light emitters 72 mounted on a light emitter positioning element 71. Referring to FIG. 7, a plurality of conductive traces 73 are formed on the light emitter positioning element 71, each solid state light emitter 72 is mounted on one of the conductive traces 73, the anode of each solid state light emitter is in contact with one of the conductive traces 73, and for each solid state light emitter 72, a wire 74 electrically connects the cathode to a next adjacent conductive trace 73, whereby the solid state light emitters 72 are electrically connected in series. Alternatively, the cathode of each solid state light emitter can be in contact with one of the conductive traces 73, and for each solid state light emitter 72, a wire 74 electrically connects the anode to a next adjacent conductive trace 73.

Figure 8:
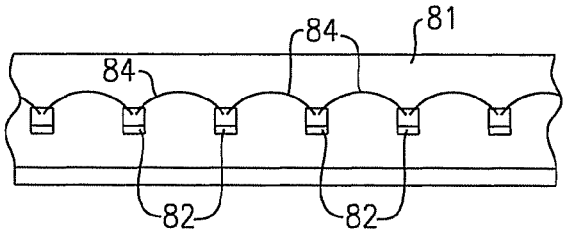
FIG. 8 is a perspective view illustrating another scheme for providing electricity to a plurality of solid state light emitters mounted on a light emitter positioning element.

FIG. 8 is a perspective view illustrating another scheme for providing electricity to a plurality of solid state light emitters 82 mounted on a light emitter positioning element 81. Referring to FIG. 8:

for each of the solid state light emitters 82 (except for one of the solid state light emitters 82 at the far left end (in the orientation depicted in FIG. 8) of the light emitter positioning element), a wire 84 electrically connects the cathode to the anode of the next solid state light emitter 82 to the left, and for each of the solid state light emitters 82 (except for one of the solid state light emitters 82 at the far right end (in the orientation depicted in FIG. 8) of the light emitter positioning element), a wire 84 electrically connects the anode to the cathode of the next solid state light emitter 82 to the right, whereby the solid state light emitters 82 are electrically connected in series (and no conductive traces are needed).

Figure 9:
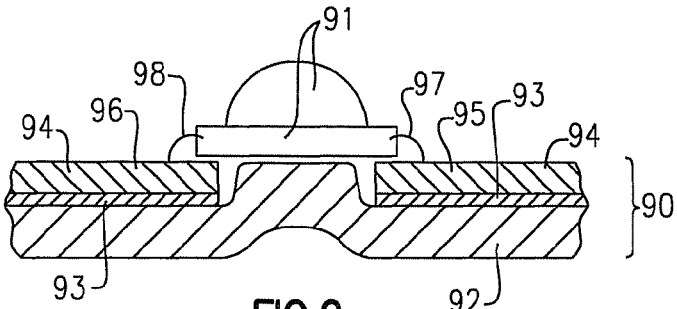
FIG. 9 is a sectional view illustrating a scheme for enhancing heat transfer from a solid state light emitter to a light emitter positioning element.

FIG. 9 is a sectional view illustrating a scheme for enhancing heat transfer from a solid state light emitter 91 to a light emitter positioning element 90. Referring to FIG. 9, there is shown a light emitter positioning element 90 that comprises a heat sink portion 92 (formed, e.g., of aluminum), an insulating layer 93 and conductive traces 94. A first region of the solid state light emitter 92 is on a first conductive trace 95 and a second region of the solid state light emitter 92 is on a second conductive trace 96, the positive contact of the solid state light emitter 92 is electrically connected (e.g., with a wire bond 97) to the first conductive trace 95, the negative contact of the solid state light emitter 92 is electrically connected (e.g., with a wire bond 98) to the second conductive trace 96, and an extended portion of the heat sink portion 92 of the first light emitter positioning element 90 extends toward a third region of the solid state light emitter 92 (and optionally is in contact with the third region of the solid state light emitter 92), whereby heat can be more effectively be transferred from the third region of the solid state light emitter 92 to the light emitter positioning element 90 than if the extended portion of the first light emitter positioning element 90 were not present. As is well known in the art, many conventional solid state light emitters have a thermal slug on a bottom surface thereof, which can serve as the "third region" in the discussion above in this paragraph.

Figure 10:
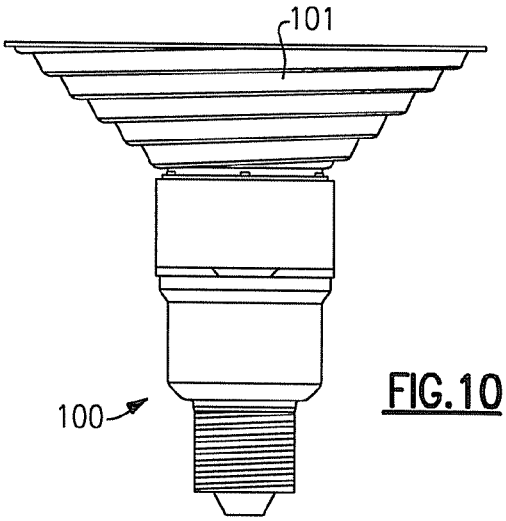
FIGS. 10 and 11 depict a lighting device 100 according to the present inventive subject matter.
Figure 11:
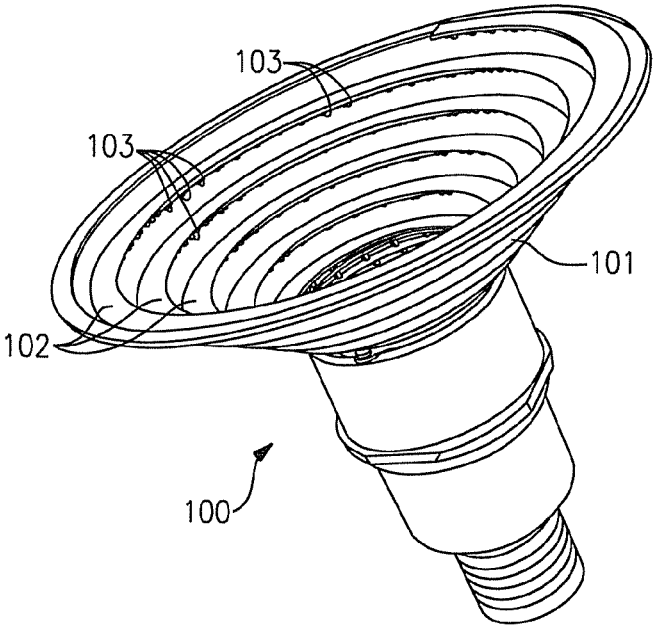

FIGS. 10 and 11 depict a lighting device 100 according to the present inventive subject matter. FIG. 10 is a front view of the lighting device 100. FIG. 11 is a perspective view of the lighting device 100. The lighting device 100 comprises a support structure 101, a light emitter positioning element 102 and a plurality of solid state light emitters 103 (in particular, light emitting diodes) positioned on the light emitter positioning element 102. The lighting device 100 also includes a connector 105 in the form of an Edison plug.

Figure 12:
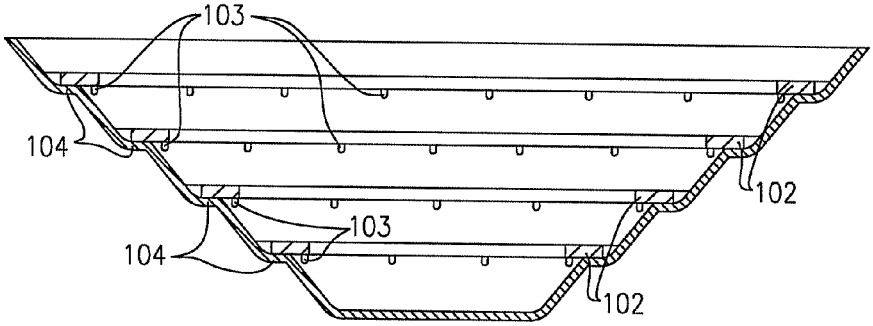
FIG. 12 is a sectional view of an upper portion of the lighting device 100 taken along the plane 12-12 in FIG. 10.

FIG. 12 is a sectional view of an upper portion of the lighting device 100 in FIG. 10. The support structure 101 comprises a spiral ledge 104 on which the spiral shaped light emitter positioning element 102 is supported.

Figure 13:
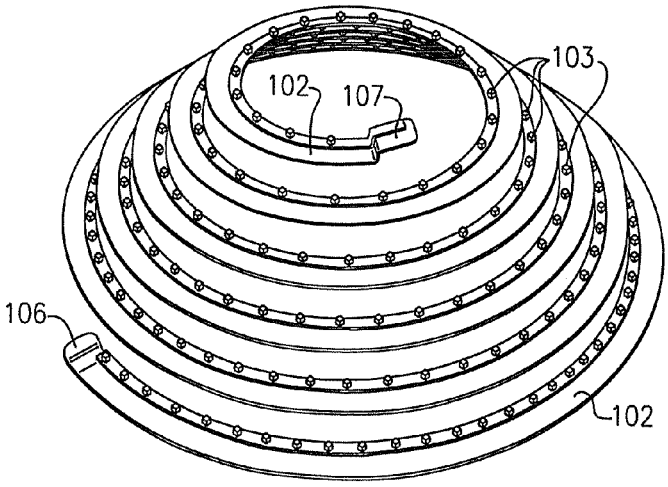
FIG. 13 is a perspective view of the light emitter positioning element 102 in the lighting device 100 depicted in FIGS. 10-12.

FIG. 13 is a perspective view of the light emitter positioning element 102 (with the light emitting diodes 103 mounted thereon), separate from the support structure 101. As shown in FIG. 13, the support structure 101 further includes a location tab 106 (that can be used to assist in positioning the light emitter positioning element 102 relative to the support structure 101 by pushing the location tab 106 through a slot in the bottom of the support structure 101 and optionally bending the location tab 106 to be nearly flat relative to the bottom of the support structure 101, e.g., to define an angle of less than 15 degrees relative to a plane defined by a surface of the bottom of the support structure 101) and a power supply connection tab 107 (that can be electrically connected to the power supply in order to supply energy to the light emitting diodes 103.

In the lighting device 100, the light emitting diodes 103 are mounted on the side of the light emitter positioning element 102 that faces the support structure 101, and the support structure 101 is reflective.

As FIG. 11 illustrates, the light emitter positioning element 102 may be oriented so that the light emitting diodes 103 are partially obscured by the windings of the light emitter positioning element 102 themselves. Thus, the windings of the light emitter positioning element 102 may be used to reflect the light from the light emitting diodes 103. Alternatively or additionally, some portions or all of the light emitter positioning element 102 can be transparent or translucent.

The windings of the light emitter positioning element 102 could be oriented so that the solid state light emitters are not obscured by the windings of the light emitter positioning element 102.

Another lighting device according to the present inventive subject matter is similar to the lighting device 100 depicted in FIGS. 10-13, except that the light emitting diodes 103 are instead mounted on the opposite side of the light emitter positioning element 102, i.e., on the side of the light emitter positioning element 102 that faces away from the support structure 101.

Figure 14:
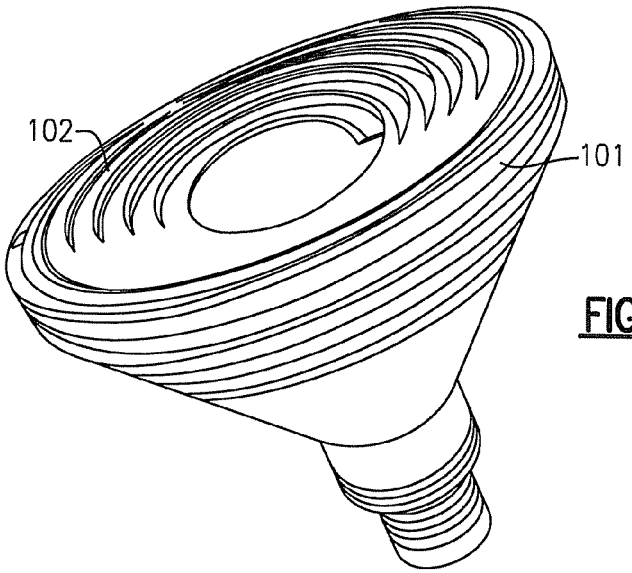
FIG. 14 depicts a lighting device in an intermediate stage of a method of making a lighting device as shown in FIGS. 10-13.

A lighting device 100 as shown in FIGS. 10-13 can be made by a method that comprises:

positioning the light emitter positioning element 102 so that its perimeter is in contact with the support structure 101 (as shown in FIG. 14), and then pressing at least a portion of the light emitter positioning element 102 to bring the light emitter positioning element 102 into contact with the ledge 104 along substantially all of the length of the ledge 104.

Figure 15:
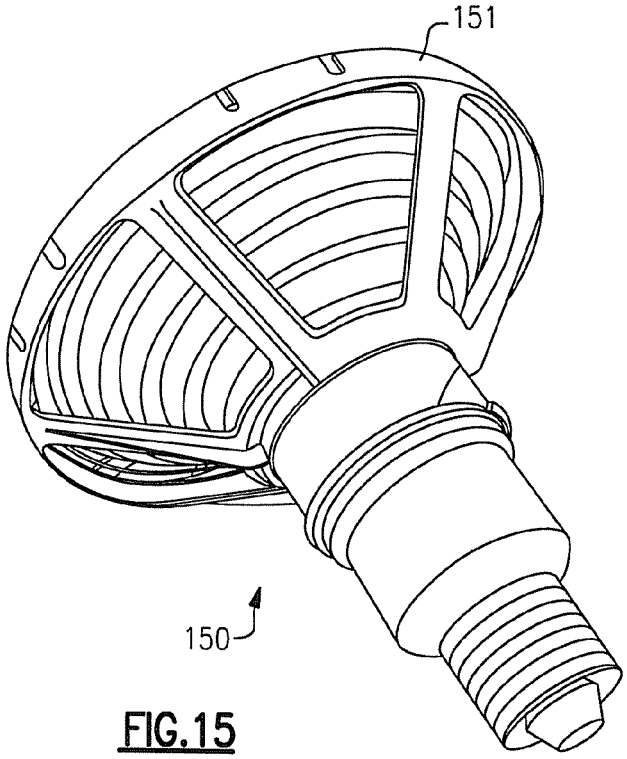
FIG. 15 is a perspective view of a lighting device 150 according to the present inventive subject matter.

FIG. 15 is a perspective view of a lighting device 150 according to the present inventive subject matter. The lighting device 150 is similar to the lighting device 100 depicted in FIGS. 10-13, except that it further comprises a bracket 151.

The embodiments depicted above comprise solid state light emitter in the form of chips. Some or all of the solid state light emitters in the depicted embodiments (as well as in many other embodiments) can instead be packaged devices positioned on the first light emitter positioning element.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

The invention claimed is:

1. A lighting device comprising:

at least a first light emitter positioning element; and at least a first solid state light emitter and a second solid state light emitter, the first and second solid state light emitters on the first light emitter positioning element, at least a first portion of the first light emitter positioning element of a closed spiral shape.

2. A lighting device as recited in claim 1, wherein the first portion of the first light emitter positioning element is of a flat spiral shape.

3. A lighting device as recited in claim 1, wherein the first portion of the first light emitter positioning element is of a non-flat spiral shape.

4. A lighting device as recited in claim 1, wherein an entirety of the first light emitter positioning element is of a spiral shape.

5. A lighting device as recited in claim 1, wherein the lighting device further comprises at least a first support structure.

6. A lighting device as recited in claim 5, wherein:

the first support structure comprises at least a first ledge, at least a portion of the first ledge is of a spiral shape, and at least a portion of the first light emitter positioning element is in contact with the ledge.

7. A lighting device as recited in claim 6, wherein at least a portion of the first support structure is reflective.

8. A lighting device as recited in claim 1, wherein at least a portion of the first light emitter positioning element is reflective.

9. A lighting device as recited in claim 1, wherein at least a portion of the first light emitter positioning element is transparent.

10. A lighting device as recited in claim 1, wherein the first light emitter positioning element comprises one or more electrically conductive regions.

11. A lighting device as recited in claim 1, wherein the first solid state light emitter and the second solid state light emitter are light emitting diodes.

12. A lighting device as recited in claim 1, wherein the lighting device further comprises at least a second light emitter positioning element, and the first and second light emitter positioning elements are at least partially interwoven.

13. A method of assembling a lighting device, comprising:

positioning a first light emitter positioning element so that at least a part of the first light emitter positioning element is in contact with a support structure, at least a first solid state light emitter and a second solid state light emitter on a first side of the first light emitter positioning element, the first side facing the support structure, the support structure comprising a ledge; and pressing at least a first portion of the first light emitter positioning element to bring the first side of the first light emitter positioning element into contact with the ledge.

14. A lighting device comprising:

at least a first light emitter positioning element; and at least a first solid state light emitter and a second solid state light emitter, the first and second solid state light emitters on the first light emitter positioning element, at least a first portion of the first light emitter positioning element of a flat spiral shape comprising at least a first substantially planar surface, the first and second solid state light emitters on the first substantially planar surface.

15. A lighting device as recited in claim 14, wherein the first portion of the first light emitter positioning element is of an open spiral shape.

16. A lighting device as recited in claim 14, wherein the lighting device further comprises at least a first support structure.

17. A lighting device as recited in claim 16, wherein:

the first support structure comprises at least a first ledge, at least a portion of the first ledge is of a spiral shape, and at least a portion of the first light emitter positioning element is in contact with the ledge.

18. A lighting device comprising:

at least a first light emitter positioning element;

at least a first solid state light emitter and a second solid state light emitter, the first and second solid state light emitters on a first side of the first light emitter positioning element; and a first support structure, at least a first portion of the first light emitter positioning element of a spiral shape, the first support structure comprising at least a first ledge, at least a portion of the first ledge of a spiral shape, and at least a portion of the first side of the first light emitter positioning element in contact with the ledge, with the first side of the first light emitter positioning element facing the support structure.

19. A lighting device as recited in claim 18, wherein the first portion of the first light emitter positioning element is of an open spiral shape.

20. A lighting device as recited in claim 18, wherein the first portion of the first light emitter positioning element is of a flat spiral shape.

* * * * *